US011982030B2

(12) United States Patent
Akhmetzhanov et al.

(10) Patent No.: US 11,982,030 B2
(45) Date of Patent: May 14, 2024

(54) METHOD AND AN APPARATUS FOR HORIZONTALLY SPLITTING A MINERAL WOOL WEB

(71) Applicant: Rockwool A/S, Hedehusene (DK)

(72) Inventors: Damir Azatovich Akhmetzhanov, Hedehusene (DK); Albert Rifovich Shakirov, Hedehusene (DK)

(73) Assignee: Rockwool A/S, Hedehusene (DK)

( * ) Notice: Subject to any disclaimer, the term of this patent is extended or adjusted under 35 U.S.C. 154(b) by 156 days.

(21) Appl. No.: 17/627,053

(22) PCT Filed: Jul. 15, 2020

(86) PCT No.: PCT/EP2020/069942

§ 371 (c)(1),
(2) Date: Jan. 13, 2022

(87) PCT Pub. No.: WO2021/009198

PCT Pub. Date: Jan. 21, 2021

(65) Prior Publication Data

US 2022/0275545 A1 Sep. 1, 2022

(30) Foreign Application Priority Data

Jul. 16, 2019 (RU) ..... RU 2019122334

(51) Int. Cl.
*D04H 1/4209* (2012.01)
*D04H 1/58* (2012.01)

(52) U.S. Cl.
CPC ..... *D04H 1/4209* (2013.01); *D04H 1/58* (2013.01)

(58) Field of Classification Search
CPC ..... D04H 1/4209; D04H 1/58
See application file for complete search history.

(56) References Cited

U.S. PATENT DOCUMENTS 5,093,069 A * 3/1992 Mellem ..... D04H 1/4209 264/510
5,981,024 A * 11/1999 Noergaard ..... D04H 1/74 428/113

(Continued)

FOREIGN PATENT DOCUMENTS

EP 0336912 A2 10/1989

OTHER PUBLICATIONS

International Search Report dated Oct. 21, 2020; International Application PCT/EP2020/069942.

*Primary Examiner* — Bao-Thieu L Nguyen
(74) *Attorney, Agent, or Firm* — DINSMORE & SHOHL LLP

(57) ABSTRACT

A method and an apparatus for horizontally splitting a mineral wool web includes a conveyor having a first direction of travel adapted for receiving and advancing a cured mineral wool web in said first direction. At least one dividing device is provided for longitudinally dividing the cured mineral wool web into at least two sub-webs as said cured mineral wool web is advanced passed said at least one dividing device. At least one lifting mechanism is provided downstream of the dividing device so that a section of the conveyor is adapted for lifting a sub-web. At least one horizontal cutting device is provided for horizontally cutting the sub-web whilst lifted in said conveyor section.

14 Claims, 2 Drawing Sheets

(56) References Cited

U.S. PATENT DOCUMENTS

| | | | | |
|---|---|---|---|---|
| 6,248,420 | B1 * | 6/2001 | Brandt | D04H 1/593 428/113 |
| 9,889,639 | B2 * | 2/2018 | Nielsen | D04H 1/4218 |
| 10,017,885 | B2 * | 7/2018 | Rosenberg | B32B 37/0046 |
| 2003/0127175 | A1 * | 7/2003 | Shoji | C04B 35/6263 156/181 |
| 2007/0264465 | A1 * | 11/2007 | Klose | B26D 3/28 428/74 |
| 2010/0186562 | A1 | 7/2010 | Schaferling | |
| 2015/0298449 | A1 * | 10/2015 | Nielsen | D04H 1/4209 156/324 |
| 2020/0308740 | A1 * | 10/2020 | Bokeloh | D04H 1/728 |

* cited by examiner

METHOD AND AN APPARATUS FOR HORIZONTALLY SPLITTING A MINERAL WOOL WEB

CROSS-REFERENCE TO RELATED APPLICATIONS

This application is the U.S. National Stage of PCT/EP2020/069942 filed Jul. 15, 2020, which claims priority to Russian Patent Application No. 2019122334 filed Jul. 16, 2019, the content of both of which are incorporated herein by reference in their entirety.

The present invention relates to a method and an apparatus for horizontally splitting a mineral wool web, comprising a conveyor having a first direction of travel adapted for receiving and advancing a cured mineral wool web in said first direction.

BACKGROUND OF THE INVENTION

A method and an apparatus of such kind are known from EP-A-0 336 912. From this disclosure, it is known to split a cured mineral wool web horizontally into an upper and a lower layer while the web is advanced on a conveyor. After the splitting, a vacuum cleaner is introduced between the upper and lower layers and dust, produced by the horizontal cutting action, is then removed.

From US 2007/0264465 A1 another apparatus for horizontally splitting a cured mineral wool web is known. According to this disclosure, the advancing mineral wool fibre web is horizontally cut and then downstream from this horizontal cutting, the web is separated into two webs organised side-by-side and then forwarded to further processing.

On present high-capacity production lines the horizontal cutting is often performed on webs with a width of 2 meters or more, typically by using a band saw that spans the full production width. However, when a cured mineral wool web is cut horizontally, the cutting action produces dust. With a large width, such as above 2 meters, the band saw leaves a relatively large amount of dust on the dividing surfaces of the upper and lower layers. For some products this is not acceptable and the surfaces must be cleaned before the mineral wool webs are being packed. As mentioned above, in EP-A-0 336 912 this problem is addressed. However, such cleaning is both time consuming and adds extra costs to the production.

SUMMARY OF THE INVENTION

The problem is that the band saw cannot remove all the dust created during the long horizontal cut. Hence, it is an object of the invention to provide a simple and cost-efficient method and apparatus for horizontally cutting a cured mineral wool web with a large width.

This object is achieved by a method for horizontally splitting a mineral wool web, comprising the steps of providing a cured mineral wool web on a conveyor, said conveyor having a first direction of travel; longitudinally dividing the cured mineral wool web into at least two sub-webs; and then lifting a sub-web by lifting a section of the conveyor, and (while lifted) horizontally cutting the lifted sub-web.

The invention further relates to an apparatus for horizontally splitting a cured mineral wool web, comprising a conveyor having a first direction of travel adapted for receiving and advancing a cured mineral wool web in said first direction; wherein there is provided at least one dividing device for longitudinally dividing the cured mineral wool web into at least two sub-webs as said cured mineral wool web is advanced passed said at least one dividing device; and wherein at least one lifting mechanism is provided downstream the dividing device, e.g. downstream direction of the travel from the dividing device, so that a section of the conveyor is adapted for lifting a sub-web, and wherein at least one horizontal cutting device is provided for horizontally cutting the sub-web whilst lifted in said conveyor section. In one embodiment there is provided exactly one dividing device, i.e. one and only one dividing device, for longitudinally dividing the cured mineral wool web into two sub-webs.

By the invention, it is advantageously found that by dividing the cured mineral wool web into two or more adjacent sub-webs and then horizontally cutting each of these sub-webs, the band saws do not cut through a large width and then the band saws are capable of removing the dust created during the horizontal cut. Accordingly, each band saw does not produce more saw dust than it can remove, and it has shown that the dividing surfaces are substantially free of saw dust. Hereby, residue saw dust is avoided on the dividing surfaces, and time consuming and costly extra cleaning operations before the packaging or further processing of the mineral wool products can be avoided.

In practice, the band saws are arranged above the production line, so that if the cured mineral wool web shall not be horizontally divided it just passes underneath the band saws. However, when the cured mineral wool web must be horizontally divided rollers or conveyors underneath each longitudinal sub-web are lifted upwards, so that each sub-web engages with a separate band saw, while it is free of the other sub-web.

Accordingly, the individual lifting each of the sub-webs is subsequently performed in a downstream direction of the travel so that the lifted sections of each of the sub-webs occur at different locations on the conveyor direction of travel so that the horizontally cuttings of the sub-webs take place separately.

In the preferred embodiments of the invention, the horizontally cutting is performed by a band saw having an endless saw band with a horizontal lower active cutting path and an upper return path, said active cutting path and said upper return path both being substantially perpendicular to the first direction of travel.

By the invention it is realised that simultaneous cutting may be performed on the at least two sub-webs. The number of sub-webs of course depend on the width of the final mineral wool products being produced relative to the width of the cured mineral wool web, and accordingly, in the simplest embodiment the cured mineral wool web is divided into two sub-webs.

In a preferred embodiment, the band saws run in opposite directions, preferably such that the active paths of each of the band saws run towards an exterior side edge of the cured mineral wool web. Hereby, the band saws remove the saw dust on the exterior sides of the production line whereby the dust is easily removable and it is avoided that the saw dust is deposited on an adjacent sub-web.

In an advantageous embodiment of the invention, there is provided an apparatus for horizontally splitting a mineral wool web, wherein a lifting mechanism is provided for each of the sub-webs subsequently in the downstream direction of the travel, so that the lifted sections of each of the sub-webs occur at different locations on the conveyor direction of travel, so that the horizontally cuttings of the sub-webs take place separately.

Preferably, the conveyor is a roller conveyor. The roller conveyor is preferably provided with sub-lines of rollers corresponding to each sub-web with the associated lifting mechanism adapted for being capable of lifting a sub-web at a section. The rollers of each sub-line of rollers is independently height-adjustable so that the sub-web being conveyed thereon can be individually lifted towards the designated band saw for that particular sub-web line.

In the preferred embodiment, the horizontal cutting device is provided above each lifting section adapted for horizontally cutting each of the sub-webs while lifted in the individual lifting section. This is advantageous as the band saw is provided such that the sub-web passes underneath the band saw if the sub-web is not lifted, and the sub-web is only engaged by the lower active cutting path of the band saw when the sub-web is lifted. Accordingly, the horizontal cutting device comprises a band saw having an endless saw band with a horizontal lower active cutting path and an upper return path, said active cutting path and said upper return path both being substantially perpendicular to the first direction of travel.

BRIEF DESCRIPTION OF DRAWINGS

In the following the invention is described in detail with reference to the accompanying drawings, in which.

DETAILED DESCRIPTION OF THE PREFERRED EMBODIMENT

Figure 1:
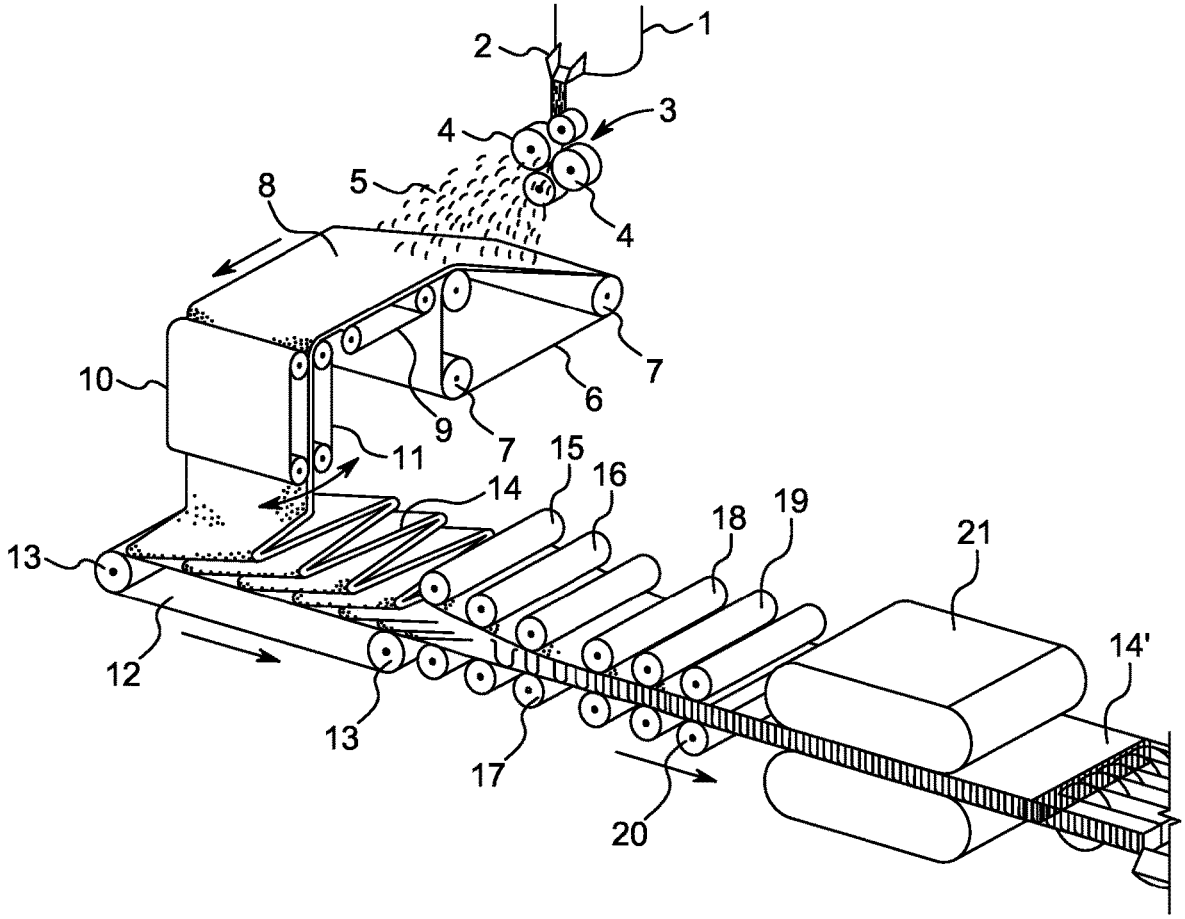
FIG. 1 is a schematically illustration of the production of a cured mineral wool web of insulating material from mineral fibres.

FIG. 1 shows schematically an example of a production line for the production of a cured web of insulating material comprising mineral fibres, in particular stone fibres. The production line comprises a furnace 1 in which mineral material, such as stone, is melted to form a mineral melt. In the shown example the mineral melt is supplied to a cascade spinner 3 having four rapidly rotating spinning wheels 4 via a melt outlet 2.

The melt is supplied onto the outer surfaces of the spinning wheels 4 and a strong gas stream is passed across the surfaces of the spinning wheels in the axial direction, thereby causing the formation of fibres 5 which are collected on an endless perforated collector belt 6 which is supported by three rollers 7, one of which is driven by driving means (not shown). An uncured binder is sprayed onto the fibres 5 before they reach the collector belt 6. As a result thereof a primary fibre web 8 is formed and this web is introduced into the space between two pendulum belts 10, 11 by means of a further endless conveyor belt.

The lower ends of the pendulum belts 10, 11 are located pivotally in a direction perpendicularly to the direction of movement of a further endless conveyor belt 12 which is supported by two rollers 13, one of which is driven by driving means (not shown).

The amplitude of the oscillation of the lower part of the pendulum belts 10, 11 corresponds to the width of the conveyor belt 12 and a doubled fibre web 14 of partially overlapping fibre layers 8 is thus formed on the belt 12. This fibre web 14 is called the secondary fibre web.

The secondary fibre web 14 is subsequently introduced into a height compression section consisting of three sets of co-operating rollers 15, 16 and 17, the spacing between the rollers in the roller sets decreasing in the longitudinal direction of the fibre web. Subsequently the secondary fibre web 14 is introduced into the longitudinal compression section which also consists of three roller sets 18, 19 and 20, the rollers of the latter sets of rollers rotating with the same velocity, which velocity is lower than that of the sets of rollers 15, 16 and 17. Conveyor belts may be applied instead of rollers for height and length compression.

The still uncured secondary fibre web is then introduced into a curing furnace 21 in which it is heated to a temperature which is sufficiently high to cure the binder and to fix the fibres relatively to one another. The result is a cured mineral wool web 14' with the desired density and thickness which is then cut into the desired products.

It should be mentioned that the cured mineral fibre web may also be the result of other production methods, such as spinning a glass melt by so-called internal centrifuging using a spinning cup provided with small orifices through which the melt forms fibres. The cross-lapping process by a pendulum may be dispensed with if the primary web already has the desired thickness and density.

Figure 2:
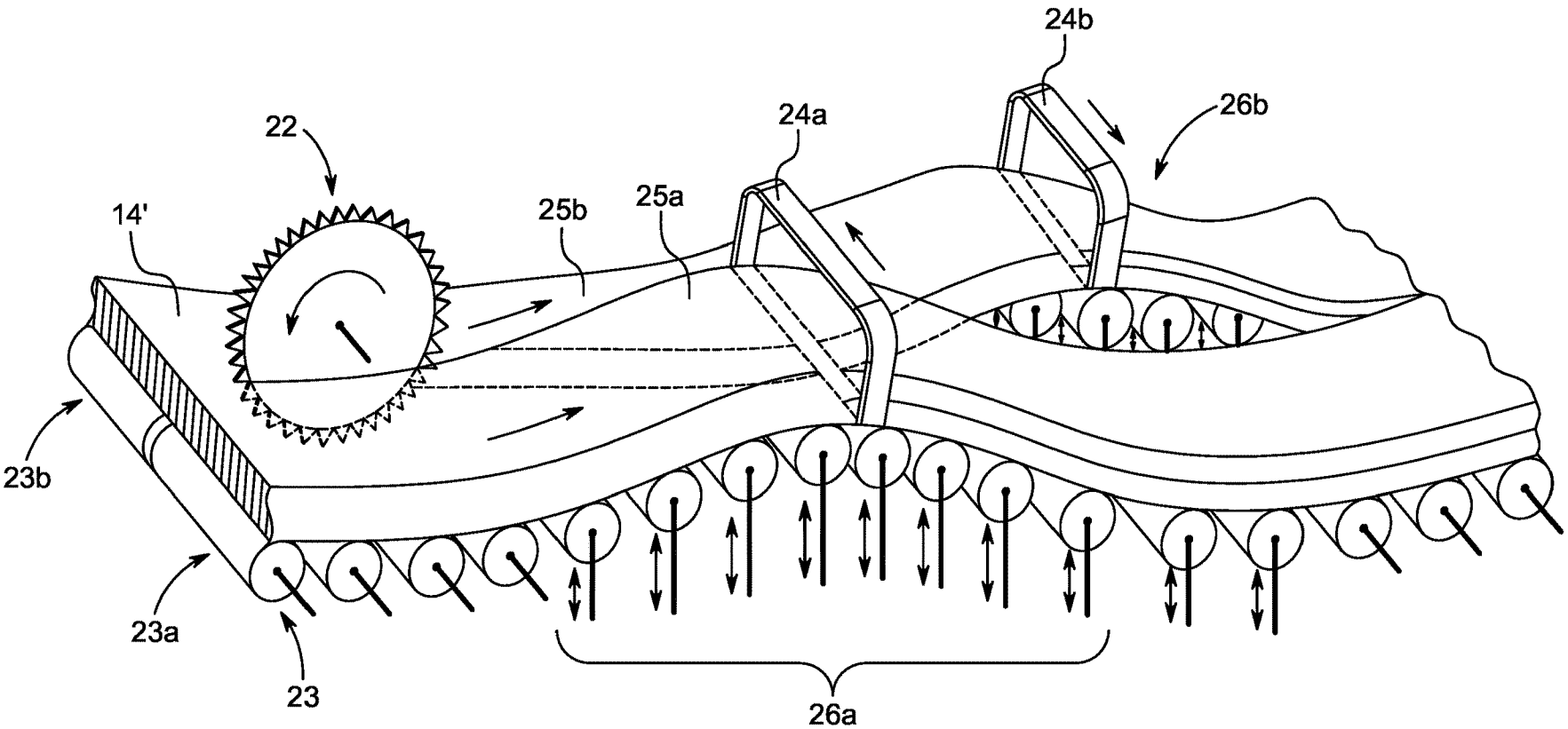
FIG. 2 is a schematic illustration of a cutting station performing the method of vertical dividing and horizontal splitting of the mineral wool web according to the invention.

The present invention is concerned with relatively thin products that are made by horizontally dividing a cured mineral wool web. A cutting station for such horizontally cutting is shown in FIG. 2.

In relation to the cutting action, the cured mineral wool web 14' is conveyed on a conveyor 23. The conveyor 23 comprises two adjacent lines of rollers 23*a*, 23*b* configured to support and transport the two sub-webs 25*a*, 25*b* produced by vertically splitting the cured mineral wool web 14' by the vertical cutter 22.

Downstream the splitting action of the vertical cutter 22, the sub-webs 25*a*, 25*b* are conveyed on the adjacent lines of conveyor rollers 23*a*, 23*b* and lifted by lifting sections 26*a*, 26*b* provided at different locations downstream the vertical cutter 22 on each of the lines of conveyor rollers 23*a*, 23*b*. Above the lifting sections 26*a*, 26*b*, there are provided associated band saws 24*a*, 24*b* adapted to perform a horizontal cutting of each of the sub-webs 25*a*, 25*b*.

The band saws 24*a*, 24*b* performing the horizontal cutting each comprise an endless saw band (which is the actual shown component of the band saws in FIG. 2) with a horizontal lower active cutting path and an upper return path, said active cutting path and said upper return path both being substantially perpendicular to the first direction of travel.

As indicated by the arrows adjacent the band saws 24*a*, 24*b*, the two band saws 24*a*, 24*b* run in opposite directions, such that the active paths of each of the band saws 24*a*, 24*b* run towards an exterior side edge of the cured mineral wool web 14'. Hereby, the band saws 24*a*, 24*b* remove the saw dust on the exterior sides of the production line and the dust is hereby easily collectable and removable and it is avoided that the saw dust is deposited in the longitudinal vertical split of the cured mineral wool web 14' and therefore ends on an adjacent sub-web 25*a*, 25*b*.

The lifting mechanism is provided for each of the sub-webs 25*a*, 25*b* subsequently in the downstream direction of the travel, so that the lifted sections 26*a*, 26*b* of each of the sub-webs 25*a*, 25*b* occur at different locations on the conveyor direction of travel, to ensure that the horizontally cuttings of the sub-webs 25*a*, 25*b* take place separately.

As mentioned above, the roller conveyor 23 is preferably provided with sub-lines 23*a*, 23*b* of rollers corresponding to each sub-web 25*a*, 25*b* with the associated lifting mechanism 26*a*, 26*b* adapted for lifting a sub-web 25*a*, 25*b* at a section. The rollers of each sub-line 23*a*, 23*b* of rollers is independently height-adjustable so that the sub-web 25*a*, 25*b* are conveyed thereon and can be individually lifted towards the designated band saw 24*a*, 24*b* for that particular sub-web line. The band saws 24*a*, 24*b* are provided such that the sub-webs 25*a*, 25*b* pass underneath the band saws 24*a*, 24*b* if the sub-webs 23*a*, 23*b* are not lifted, and such that the sub-webs 25*a*, 25*b* are only engaged by the lower active cutting path of the band saws 24*a*, 24*b* when the sub-webs 25*a*, 25*b* are lifted.

In an alternative embodiment (not shown) the roller conveyor 23 comprises rollers spanning the full width of the production line instead of providing separate sub-lines 23*a*, 23*b* of rollers for supporting each sub-web 25*a*, 25*b*. In this embodiment the lifting mechanism 26*a*, 26*b* comprises additional rollers arranged between the rollers of the roller conveyor 23 which additional rollers are height adjustable for individually lifting each sub-web 25*a*, 25*b* upwards from the roller conveyor 23.

In modern high-capacity production lines the width of the cured mineral wool web is typically around 2 meters. It may be as low as 1.8 meters, but is often as high as 2.4 meters or even more. The density of the cured mineral wool web is often in the range of 25 to 190 kg/m3 depending on the final usage of the product. Often the thickness of the cured mineral wool web before horizontally splitting is 50 to 100 mm which, after horizontally cutting results in products with a thickness of 25 to 50 mm. The line speed may be as low as 2 m/s (for high density products) or as high as 18 m/s (for low density products). The cutting speed of the band saws 24*a*, 24*b* may be 10-18 m/s or even 10-25 m/s. The cutting speed can be regulated according to the line speed, the density of the cured mineral wool web and the like.

As mentioned above, the two band saws 24*a*, 24*b* run in opposite directions. The band saws may run at the same cutting speed or different cutting speeds if appropriate. The band saws may be of the same type or of different types depending on what is most appropriate.

Above, the invention is described with reference to some currently preferred embodiments. As shown in FIG. 2 each sub-webs 25*a*, 25*b* can be lifted with a longitudinally distance in a lifting section 26*a*, 26*b*. There may of course be more than two longitudinal sub-webs 25*a*, 25*b*, such as three or four, depending on the final product dimensions. Further band saws 24*a*, 24*b* must then also be provided. Other variants may also be provided without departing from the scope of the invention as it is defined by the accompanying claims.

The invention claimed is:

1. A method for horizontally splitting a cured mineral wool web, comprising the steps of:

providing a cured mineral wool web on a conveyor, said conveyor having a first direction of travel;

longitudinally dividing the cured mineral wool web into at least two sub-webs; and then lifting a sub-web by lifting a section of the conveyor, and horizontally cutting the lifted sub-web.

2. The method according to claim 1, wherein individually lifting each of the sub-webs is subsequently performed in a downstream direction of the travel so that the lifted sections of each of the sub-webs occur at different locations on the conveyor direction of travel so that the horizontally cuttings of the sub-webs take place separately.

3. The method according to claim 1, wherein the horizontally cutting is performed by a band saw having an endless saw band with a horizontal lower active cutting path and an upper return path, said active cutting path and said upper return path both being substantially perpendicular to the first direction of travel.

4. The method according to claim 1, wherein simultaneous cutting is performed on the at least two sub-webs.

5. The method according to claim 1, wherein the cured mineral wool web is divided into two sub-webs.

6. The method according to claim 5, wherein the band saws run in opposite directions, such that the active paths of each of the band saws run towards an exterior side edge of the cured mineral wool web.

7. An apparatus for horizontally splitting a cured mineral wool web, comprising:

a conveyor having a first direction of travel adapted for receiving and advancing a cured mineral wool web in said first direction;

at least one dividing device for longitudinally dividing the cured mineral wool web into at least two sub-webs as said cured mineral wool web is advanced passed said at least one dividing device;

at least one lifting mechanism provided downstream of the dividing device so that a section of the conveyor is adapted for lifting a sub-web; and at least one horizontal cutting device provided for horizontally cutting the sub-web whilst lifted in said conveyor section.

8. The apparatus according to claim 7, wherein a lifting mechanism is provided for each of the sub-webs subsequently in the downstream direction of the travel, so that the lifted sections of each of the sub-webs occur at different locations on the conveyor direction of travel, so that the horizontally cuttings of the sub-webs take place separately.

9. The apparatus according to claim 7, wherein the conveyor is a roller conveyor.

10. The apparatus according to claim 9, wherein the roller conveyor is provided with sub-lines of rollers corresponding to each sub-web with the associated lifting mechanism adapted for being capable of lifting a sub-web at a section.

11. The apparatus according to claim 7, wherein the horizontal cutting device is provided above each lifting section adapted for horizontally cutting each of the sub-webs while lifted in the individual lifting section.

12. The apparatus according to claim 7, wherein the at least one horizontal cutting device comprises a band saw having an endless saw band with a horizontal lower active cutting path and an upper return path, said active cutting path and said upper return path both being substantially perpendicular to the first direction of travel.

13. The apparatus according to claim 7, wherein there is provided one dividing device for longitudinally dividing the cured mineral wool web into two sub-webs.

14. The apparatus according to claim 13, wherein the band saws are arranged to run in opposite directions, such that the active paths of each of the band saws run towards an exterior side edge of the initial web.

* * * * *